United States Patent [19]

Godsey

[11] 4,305,218

[45] Dec. 15, 1981

[54] SAFETY MECHANISM FOR A FIREARM

[76] Inventor: Floyd E. Godsey, Box 154, Willow Creek, Calif. 95573

[21] Appl. No.: 126,682

[22] Filed: Mar. 3, 1980

[51] Int. Cl.[3] ..... F41C 17/04

[52] U.S. Cl. ..... 42/70 F; 42/70 R

[58] Field of Search ..... 42/70 F, 70 R, 69 A

[56] References Cited

U.S. PATENT DOCUMENTS

| | | | |
|---|---|---|---|
| 2,484,977 | 10/1949 | Wilcox | 42/70 F |
| 2,514,981 | 7/1950 | Walker et al. | 42/70 R |
| 2,824,402 | 2/1958 | Fischer | 42/70 R |
| 3,601,918 | 8/1971 | Keppeler | 42/70 F |

*Primary Examiner*—Charles T. Jordan

*Attorney, Agent, or Firm*—Chernoff & Vilhauer

[57] ABSTRACT

A safety device for a bolt action firearm has a laterally extending lock pin which is movable laterally to engage a recess in the cocking lug of the striker to prevent the striker from moving forward despite sear release by the trigger mechanism. An operating lever is movable rearward from a forward position in which the firearm may be discharged, rotating a helical cam which moves the lock pin laterally into the recess in the cocking lug. When the lever is moved further rearward, a cam on the operating lever pivots a blade upward into a groove in the bolt to prevent rotation of the bolt.

13 Claims, 9 Drawing Figures

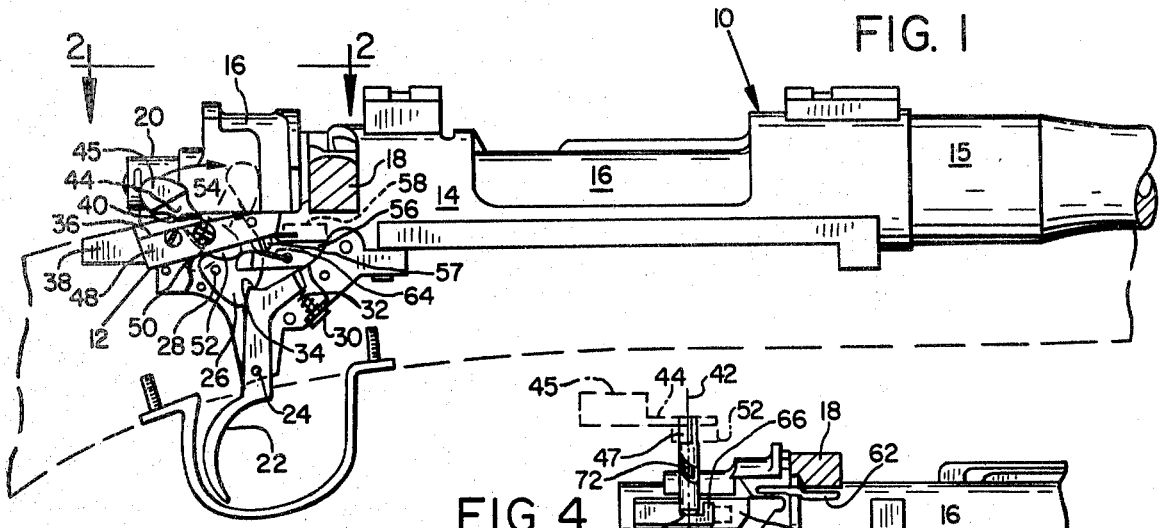
FIG. 1
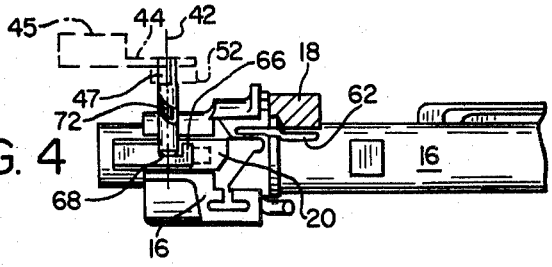
FIG. 4
FIG. 3
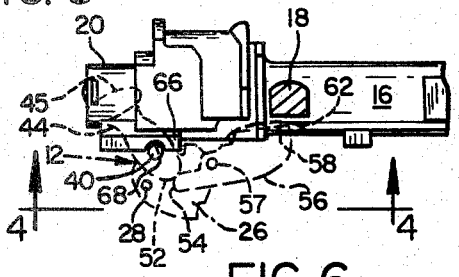
FIG. 2
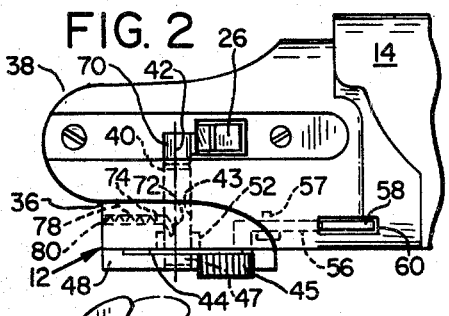
FIG. 6
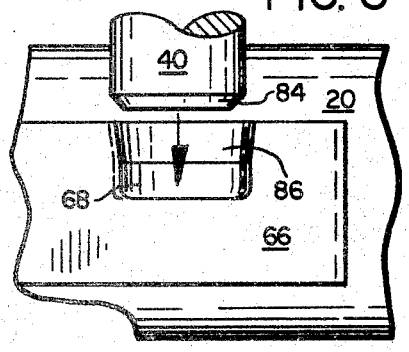
FIG. 7
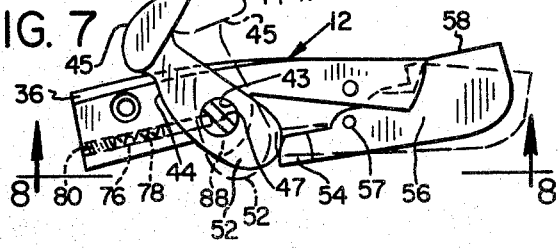
FIG. 8
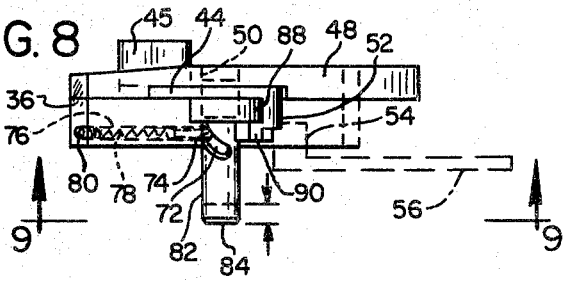
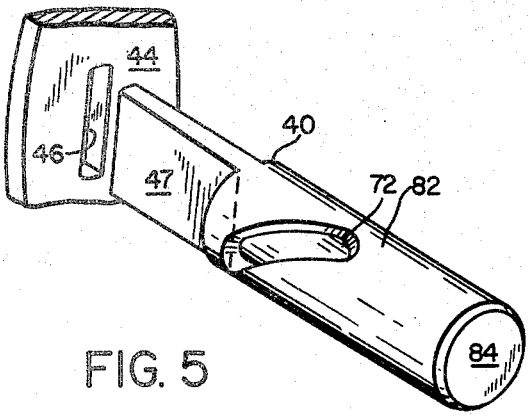
FIG. 5
FIG. 9
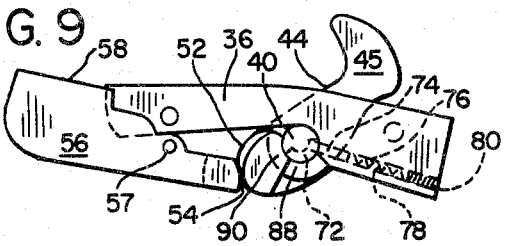

SAFETY MECHANISM FOR A FIREARM

BACKGROUND OF THE INVENTION

The present invention relates to improvements in firearms and particularly to an improved safety mechanism for bolt action firearms.

A long-standing problem in bolt action firearms is that when the bolt is rotated to the unlocked position in opening the breech, the firearm may accidentally discharge a cartridge contained in its chamber. This occurs because many safety mechanisms for bolt action firearms must be placed in an "off-safe," or firing, position to permit the bolt to be raised from its closed and locked position.

Particularly when firearms have been designed or modified for hunting use, the trigger mechanism is often adjusted to require only a very small amount of movement to release the striker which propels the firing pin into the primer of the cartridge. While in most military rifles an appreciable amount of slack in the trigger mechanism must be taken up before the striker is released, such firearms when modified for hunting use ordinarily do not have such slack in the trigger mechanism, and are subject to accidental discharge as a result.

Some bolt action firearms employ a safety mechanism attached to the rear end of the breech bolt. Typically, a knob or small lever of such a safety mechanism must be moved to engage or disengage the safety, a movement requiring the shooter to release his grip on the stock of the firearm.

Most previously known safety mechanisms for bolt action firearms are either of the bolt mounted type just described, or else operate by blocking a portion of the trigger or sear mechanism, preventing the trigger from being moved sufficiently for the sear to release the striker. Because of the short distance which the trigger must move to discharge a cartridge in a firearm designed for hunting use, however, even a small amount of wear in a safety mechanism of this type may be sufficient to allow an accidental discharge of the firearm, upon rotation of the bolt to open the breech, or should the trigger snap on an object as the firearm is being carried.

Customarily, in the case of known firearms which are provided with a lock for securing the bolt against rotation, the bolt lock is coupled with the safety mechanism in such a way that when the safety mechanism is set on "safe," the bolt is prevented from opening. In such firearms, then, the bolt and firing mechanism are both locked or else both capable of actuation. As a result, there is a definite uncertainty while handling the firearm, because a shot can be accidentally discharged as the bolt is rotated.

What is needed, therefore, is a safety mechanism for a bolt action firearm which can secure the bolt in its locked position, preventing opening of the bolt and also preventing actuation of the firearm, and which selectively permits rotation of the bolt from its locked position while still preventing discharge of a cartridge. Additionally, such a safety mechanism should be handily operable by the shooter without the need to remove his hand from its normal position on the stock of the firearm.

SUMMARY OF THE INVENTION

The present invention overcomes the aforementioned shortcomings and disadvantages of previously known safety mechanisms by providing a three-position safety mechanism mounted on the tang of the receiver of the bolt action firearm, where it is thumb-operable. In one "safe" position the safety mechanism of the present invention prevents discharge of the firearm and also prevents rotation of the bolt, while in another "safe" position it prevents discharge of the firearm, yet allows rotation of the bolt from its closed-and-locked position to a position in which the safety mechanism of the firearm prevents the firearm from discharging the cartridge. In a third, or "off-safe" position the safety mechanism permits discharge of the weapon.

It is therefore a primary objective of the present invention to provide an improved safety mechanism for use in bolt action firearms.

It is another important objective of the present invention to provide a safety mechanism for bolt action firearms which cannot be overcome by pulling the trigger of such firearm.

It is yet another important objective of the present invention to provide a safety mechanism which prevents discharge of the firearm independently of the trigger and sear mechanism.

It is yet a further objective of the present invention to provide a safety mechanism which prevents inadvertent rotation of the breech bolt of a bolt action firearm.

It is a still further objective of the present invention to provide a safety mechanism which is operable without the need for the shooter to move his hand from its normal position gripping the stock of the firearm.

The present invention provides a thumb-operated three-position safety mechanism which is located conveniently on the tang of the receiver portion of the firearm. It is applicable to nearly any bolt action firearm having a striker located at the rear of the bolt, and having a cocking lug for engaging the sear mechanism on the bottom of the striker.

The safety mechanism of the invention comprises a lock pin which extends laterally toward the striker through a bore provided in the tang of the receiver, and which is laterally movable by action of a cam to engage and hold the striker, preventing discharge of the firearm. Another cam is used to move a blade into a groove in the breech bolt of the firearm to secure the bolt in a closed position.

In a preferred embodiment, one end of the lock pin fits into an opening in a safety mechanism operating lever which extends upward from the tang of the receiver to a position where a shooter can easily move the lever with his thumb. Movement of the lever forward or rearward rotates the lock pin, and a helical cam groove included in the lock pin moves it laterally of the firearm as it is rotated. When the firearm is cocked, the lock pin can be moved in this manner into a recess which is provided in the cocking lug. As the lock pin extends into the recess in the cocking lug, it engages a conical inner surface of the recess in the cocking lug, forcing the cocking lug, and thereby also the striker, to move a slight distance rearward within the receiver With the lock pin engaged in the recess in the cocking lug, the sear lever is free to move away from and to return to its position locking the cocking lug, allowing operation of the trigger mechanism while the safety mechanism is in one of the two "safe" positions. The lock pin of the safety mechanism of the present invention thus holds the striker securely in a rearward position independently of the trigger mechanism, preventing discharge of the firearm despite operation of the trigger mechanism and despite jarring which might otherwise cause an accidental discharge.

Further movement of the operating lever of the safety mechanism, in the direction required to engage the lock pin in the recess of the cocking lug, moves a cam attached to the operating lever into contact with a follower located on one end of a blade which is pivotably mounted on the receiver of the firearm. The cam pivots the blade about an axis generally perpendicular to the blade, raising an edge of the blade through a slot provided in the receiver of the firearm into a groove provided in the bolt of the firearm, thereby preventing the bolt from rotating away from its closed-and-locked position closing the breech.

It is, therefore, a principal feature of the invention that it includes a laterally-extending lock pin which is movable laterally into locking engagement in a recess provided in a part of the striker of a bolt action firearm, to positively engage and retain the striker, preventing discharge of the firearm.

It is another important feature of safety mechanism of the present invention that the lock pin positively moves the striker rearward in the receiver of the firearm as the lock pin moves into the recess provided in the cocking lug.

It is another important feature of the present invention that when the operating lever of the safety mechanism is in an intermediate position, the bolt may be rotated, but the cocking lug is held securely, preventing discharge of the firearm.

It is a primary advantage of the present invention that it provides greater safety then previously known safety mechanisms for bolt action firearms, since it locks the striker independently of the trigger mechanism of the firearm.

It is another primary advantage of the present invention that it is more convenient to operate than a bolt-mounted safety mechanism.

It is a further advantage of the present invention that it is less susceptible to wear than safety mechanisms which depend upon lockage of the trigger mechanism, particularly in firearms requiring only a slight movement of the trigger to discharge the firearm.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a fragmentary partially cut away side elevational view of a rifle including an exemplary safety mechanism embodying the present invention.

FIG. 2 is a top view of the rear portion of the receiver of the rifle shown in FIG. 1, with the bolt removed.

FIG. 3 is a partially sectional side elevational view of a portion of the bolt of the rifle shown in FIG. 1, showing the lock pin and the blade of the safety mechanism shown in FIG. 1 engaged therein.

FIG. 4 is a bottom view, taken along line 4—4 of FIG. 3, of a portion of the bolt shown in FIG. 3, with the lock pin of the safety mechanism of the invention engaged therein.

FIG. 5 is a pictorial view, at an enlarged scale, of the lock pin of the safety mechanism shown in FIG. 1.

FIG. 6 is a bottom view, at an enlarged scale, of a detail of the bolt of the rifle shown in FIG. 1, showing the relationship between the lock pin of the safety mechanism and the cocking lug of the bolt.

FIG. 7 is a right side elevational view, at an enlarged scale, of the safety mechanism shown in FIG. 1.

FIG. 8 is a bottom view of the safety mechanism shown in FIG. 1, taken along line 8—8 of FIG. 7.

FIG. 9 is a left side elevational view of the safety mechanism shown in FIG. 1, taken along line 9—9 of FIG. 8.

DETAILED DESCRIPTION OF THE INVENTION

A bolt action rifle 10, equipped with a safety mechanism 12 which is a preferred embodiment of the present invention, is shown in FIG. 1. The rifle 10 comprises a receiver 14 having a barrel 15 attached at its forward end. A breech bolt 16 is operatively mounted in the receiver 14 to block the breech of the barrel 15. A bolt handle 18 of the breech bolt 16 is shown (partially cut away for clarity) in a forward-and-down, closed-and-locked position, and a striker 20 carried by the bolt 16, is in its cocked position, in which it is held rearward with respect to the bolt 16 against the force of a striker spring (not shown).

The trigger mechanism of the rifle comprises a trigger 22, pivotably mounted on a trigger pivot pin 24, and a sear lever 26 mounted on a sear pivot pin 28. A forward end of the trigger 22 is supported by a trigger adjusting screw 30 and a trigger spring 32, while a sear 34 is provided on an upper portion of the trigger 22 to releasably hold the sear lever 26 in a position interfering with the forward movement of the striker 20 when the firearm is cocked.

Referring now also to FIGS. 2–5, the safety mechanism of the present invention may be seen to comprise a backing piece 36 fitted against one side of the tang 38 of the receiver 14 of the rifle 10, and a lock pin 40, having a longitudinal axis 42, which extends laterally through a bore 43 defined in the backing piece 36 and the tang 38 of the receiver 14. An operating lever extends upward above the backing piece 38 and has a head 45 shaped to be conveniently moved by thumb pressure. An elongated opening 46, through which an outer end portion 47 of the lock pin 40 extends, is defined in the operating lever 44. A cover plate 48 is secured to the backing piece to limit movement of the operating lever 44, while a hole 50 defined in the cover plate 48 and located in alignment with the elongated opening 46 permits the lock pin 40 to move laterally and also permits observation of the position of the lock pin 40. The operating lever 44 may be moved forward, rotating about a pivot axis coincident with the central longitudinal axis 42 of the lock pin 40, from the position shown in solid line in FIG. 1, in which the safety mechanism of the invention is in a "safe" position, to the "off-safe" position shown in broken line, which permits the rifle 10 to be discharged.

A cam 52, is located on the lower portion of the operating lever 44, where it engages a follower 54 connected to a blade 56. The blade 56 is pivotably secured to the receiver 14 by, for example, a blade mounting screw 57 extending laterally through the blade into the receiver 14. An edge 58 of the blade 56 extends upward through a slot 60 in the receiver, engaging a groove 62 defined in the bottom of the bolt 16, near the bolt handle 18, preventing the bolt 16 from rotating out of its forward-and-down locked position. A blade spring 64 normally retains the edge 58 in a lowered position, disengaged from the groove 62, unless the cam 52 is holding the follower 54 downward.

As may be seen in FIGS. 2–4, a cocking lug 66, a part of the striker 20, extends downward where, when the rifle 10 is cocked, the sear lever 26, held in its raised position by the sear 34, obstructs it, preventing the striker 20 from moving forward to discharge a cartridge. The bore 43 is located in a position in the tang 38 of the receiver 14 which permits the lock pin 40 to be moved laterally through the bore 43 into a recess 68 defined in the cocking lug 66 when the striker 20 is in a cocked condition.

The location of the safety mechanism 12 relative to the tang 38 of the receiver 14 may be seen in FIG. 2 with the safety mechanism 12 shown in an "off-safe" position. A half cylindrical recess 70 is also provided in the central portion of the tang 38 of the receiver 14, a slight distance rearward of the sear lever 26, to provide clearance for the lock pin 40 to move laterally into engagement in the recess 68 in the cocking lug.

FIG. 3 shows that the recess 68 provided in the cocking lug 66 receives only a top portion of the lock pin 40 when the lock pin 40 is extended laterally into engagement therein. FIG. 3 also shows clearly the manner in which the edge 58 of the blade 56 engages the groove 62 defined in the bottom of the bolt 16 to prevent rotation of the bolt when the operating lever 44 is in its rearmost position.

The rear portion of the bolt 16 is shown in FIG. 4, where it may be seen that the lock pin 40 extends across only a portion of the width of the cocking lug 66. This leaves a longitudinally oriented flat portion of the cocking lug 66 which holds the sear lever downward as the cocking lug 66 moves relative to the sear lever 26 during intentional discharge and recocking of the rifle.

A helical cam groove 72 defined in the lock pin 40 is coaxial with the longitudinal axis 42 of the lock pin 40. A plunger 74, located in a tubular recess 76 defined in the backing piece 36, is held in a position of engagement in the helical cam groove 72 by a plunger spring 78 and a retaining screw 80. The pitch of the helical cam groove 72 is steep enough so that the plunger 74 forces the lock pin 40 to move laterally between positions of engagement in and disengagement from the recess 68 as the lock pin 40 is rotated approximately one quarter revolution by movement of the operating lever 44.

Referring now also to FIGS. 5 and 6, the lock pin 40 may be seen to comprise a generally cylindrical portion 82 which normally extends through the lateral bore 43 defined in the backing piece, 36 and tang 38 and which includes the helical cam groove 72. The outer end portion 47 of the lock pin is shaped to fit within the elongated opening 46 defined in the operating lever 44, so that movement of the operating lever 44 causes rotation of the lock pin 40 within the bore 43. The elongated opening 46 of the operating lever 44 fits over the flat-sided outer end portion 47 of the lock pin 40 loosely enough to permit the lock pin 40 to slide laterally (with respect to the rifle) through the elongated opening 46, and to provide for a slight movement of the operating lever 44 without rotating the lock pin 40. An inner end 84 of the lock pin is chamfered to permit the lock pin 40 to initially engage a slightly conical inner surface 86 of the recess 68 defined in the cocking lug 66, so that as the lock pin 40 moves laterally into engagement in the recess 68 the cocking lug 66 is moved rearwardly, away from the breech of the rifle 10, as indicated in broken line in FIG. 6.

Referring to FIGS. 7, 8 and 9, showing the safety mechanism 12 of the present invention at an enlarged scale, the position of the plunger 74 relative to the lock pin 40, and the position of the cam 52 of the operating lever relative to the follower 54 of the blade 56, may be seen more clearly. Referring particularly to FIG. 7, the operating lever 44 is shown in solid line in its rearmost position, in which the safety mechanism 12 prevents the striker 20 from moving and also prevents the bolt 16 from rotating. With the operating lever 44 in an intermediate position shown in broken line the blade 56 is permitted to rotate clockwise from its solid line position, moving the edge 58 downward out of engagement with the groove 62 defined in the bolt 16 to the position shown in broken line.

From FIG. 8, a bottom view of the safety mechanism 12, it may be seen that the bottom portion of the backing piece 36 comprises a semi-circular ear 88. The cam 52 of the operating lever 44 extends laterally toward the receiver 14, while the follower portion 54 of the blade 56 extends outward away from the receiver 14 to be engaged by the cam 52. The portion of the operating lever including the cam 52 extends laterally inward a short distance beyond the ear 88, and a retaining leg 90 of the operating lever extends toward the bore 43, fitting around the ear 88, so that the entire operating lever, including the cam 52 and the retaining leg 90, has the shape of a "J." When the plunger 74 is engaged in the helical cam 72 with the lock pin 40 through the bore 43 and the elongated opening 46, the retaining leg 90 holds the operating lever in position on the backing piece 36.

Operation of the safety mechanism of the invention is simple and certain. With the operating lever 44 of the safety mechanism 12 in in its forwardmost position, the rifle bolt 16 may be rotated and moved forwardly or rearwardly, and the rifle 10 may be discharged by pulling the trigger 22 rearwardly. With the rifle 10 cocked, when the striker 20 is held in a rearward position by the sear lever 26 extending upward in contact with the forward surface of the cocking lug 66, the operating lever 44 of the safety mechanism 12 may be moved rearwardly to an intermediate position, as shown in broken line in FIG. 7. Moving the operating lever 44 rearwardly rotates the lock pin 40 so that the plunger 74, engaged in the helical cam groove 72, forces the lock pin 40 to move inwardly through the bore 43 and into engagement in the recess 68 in the cocking lug 66, moving the cocking lug 66 slightly rearwardly, away from the barrel 15, and preventing the striker 20 from moving forward to discharge a cartridge. The slight rearward displacement of the cocking lug 66 ensures that the sear lever 26, if displaced while the safety mechanism is set to a "safe" condition, will have sufficient clearance to return to its position blocking the cocking lug 66 upon removal of the influence which displaced it.

If the bolt handle 18 is in its forward-and-down locked position, the operating lever 44 of the safety mechanism 12 may be moved further rearwardly to a rearmost position. Moving the operating lever fully rearward continues to rotate the lock pin 40, causing it to move further into the recess 68 in the cocking lug 66, and simultaneously brings the cam 52 of the operating lever 44 into engagement against the follower 54 of the blade 56, forcing the follower 54 downward and pivoting the edge 58 of the blade 56 upward into engagement in the groove 62 defined in the bottom of the bolt 16. With the edge 58 thus engaged in the groove 62, the bolt 16 is prevented from rotating. Thus the safety mechanism 12 of the invention, when its operating lever 44 is in the rearmost "safe" position, prevents both movement of the bolt 16 and discharge of the firearm.

Moving the operating lever 44 forward from the rearmost position to the intermediate position moves the cam 52 away from the follower 54, permitting the blade spring 64 to rotate the blade 54 about the blade mounting screw 57, disengaging the edge 58 from the groove 62. Because of the slight clearance between the outer end 47 of the lock pin 40 and the elongate opening 46 in the operating lever 44, and because of a small amount of lost motion in the fit of the plunger 74 in the helical cam groove 72, the edge 58 can be disengaged from the groove 62 with little or no withdrawal of the lock pin 40 from the recess 68.

It will be apparent that detent mechanisms (not shown) may be provided to ensure that the operating lever 44 is not inadvertently moved through the intermediate position to the "off-safe" or firing position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A safety mechanism for a bolt action firearm having a receiver, a bolt mounted in the receiver, and a striker movable reciprocally with respect to the bolt, the safety mechanism comprising:

(a) lock pin means associated with said receiver extending laterally of said firearm and reciprocatingly movable laterally of said firearm, for engaging said striker and preventing its movement;

(b) blade means associated with said receiver and movable into locking engagement in said bolt when said bolt is in a closed-and-locked position, for preventing rotation thereof; and (c) cam means for moving said lock pin into engagement with said striker and moving said blade into engagement with said bolt.

2. The safety mechanism of claim 1, said cam means including helical cam means for moving said lock pin means laterally into engagement with said striker.

3. The safety mechanism of claim 1 including operating lever means for rotating said lock pin means, said cam means including helical cam means on said lock pin means for moving said lock pin means laterally of said firearm in response to rotation thereof by said operating lever means.

4. The safety mechanism of claim 3, including cam means on said operating lever means, and follower means operably connected with said blade means, for moving said blade means into engagement with said bolt.

5. The safety mechanism of claim 4, wherein said operating lever means is movable between a first position permitting said firearm to be discharged, a second position wherein said bolt is free to be rotated but said lock pin is in locking engagement with said striker, and a third position, in which said lock pin is in locking engagement with said striker and said blade is in engagement with said bolt, preventing rotation thereof.

6. In a bolt action firearm having a receiver and a breech bolt mounted in said receiver for reciprocal rotation about a longitudinal axis of said breech bolt, between a locked position and an unlocked position and for reciprocal longitudinal movement between a forward, breech-closing position and a rearward position, a safety mechanism for preventing inadvertent discharge, comprising:

(a) a striker mounted on said firearm for reciprocal movement with respect to said bolt;

(b) a lock pin having a longitudinal axis extending laterally with respect to said firearm, said lock pin being mounted for reciprocal axial movement into and out of a position of engagement with said striker, said lock pin preventing forward movement of said striker sufficient to discharge said firearm when in said position of engagement;

(c) operating lever means mounted on said firearm for rotating said lock pin about said longitudinal axis of said lock pin; and (d) cam means for causing said reciprocal axial movement of said lock pin in response to rotation of said lock pin by said operating lever means.

7. The safety mechanism of claim 6 wherein said receiver has a rearwardly extending tang and said operating lever means is pivotally mounted on a side of said tang for reciprocal rotation about an axis extending transversely with respect to said firearm.

8. The safety mechanism of claim 6 wherein said striker includes a recess defined in a portion thereof and wherein said position of engagement comprises said lock pin extending into said recess, preventing forward motion of said striker when said lock pin is in said position of engagement.

9. The safety mechanism of claim 8 wherein said lock pin includes a tapered portion, said lock pin being so located with respect to said recess, when said firearm is in a cocked condition, that as said lock pin is moved into said position of engagement said tapered portion moves said striker rearward with respect to said receiver.

10. The safety mechanism of claim 8 wherein said striker includes a conical surface defining a portion of said recess, said lock pin being so located with respect to said recess when said firearm is cocked that as said lock pin is moved into said position of engagement in said recess said lock pin engages said conical surface, moving said striker rearward with respect to said receiver.

11. The safety mechanism of claim 6, further comprising:

a groove defined in said bolt;

a blade mounted on said receiver for reciprocal movement into and out of engagement in said groove, said blade preventing rotation of said bolt when engaged in said groove; and means associated with said operating lever, for moving said blade.

12. The safety mechanism of claim 11 wherein said means for moving said blade comprises a cam located on said operating lever and a follower connected with said blade.

13. The safety mechanism of claim 11 wherein said operating lever is movable between a first position in which said firearm may be discharged, a second position wherein said bolt is free to be rotated but said lock pin is in locking engagement with said striker, and a third position, in which said lock pin is in locking engagement with said striker and said blade is in engagement with said bolt, preventing rotation thereof.

* * * * *

UNITED STATES PATENT AND TRADEMARK OFFICE

CERTIFICATE OF CORRECTION

PATENT NO. : 4,305,218

DATED : December 15, 1981

INVENTOR(S) : Floyd E. Godsey

It is certified that error appears in the above-identified patent and that said Letters Patent are hereby corrected as shown below:

Col. 1, Line 43 Change "snap" to --snag--.

Signed and Sealed this

*Fifteenth* Day of *June 1982*

[SEAL]

*Attest:*

GERALD J. MOSSINGHOFF

*Attesting Officer* *Commissioner of Patents and Trademarks*